US007707123B2

(12) United States Patent
Bleumer

(10) Patent No.: US 7,707,123 B2
(45) Date of Patent: Apr. 27, 2010

(54) METHOD AND ARRANGEMENT FOR COMPENSATING A POSTAGE MACHINE USER FOR PRINTED AND BILLED, BUT UNUSABLE FRANKING IMPRINTS

(75) Inventor: Gerrit Bleumer, Sohildow (DE)

(73) Assignee: Francotyp-Postalia GmbH (DE)

( * ) Notice: Subject to any disclaimer, the term of this patent is extended or adjusted under 35 U.S.C. 154(b) by 746 days.

(21) Appl. No.: 11/170,642

(22) Filed: Jun. 29, 2005

(65) Prior Publication Data

US 2006/0004676 A1 Jan. 5, 2006

(30) Foreign Application Priority Data

Jul. 2, 2004 (DE) ..... 10 2004 032 323

(51) Int. Cl.
*G07B 17/02* (2006.01)
*G07B 17/00* (2006.01)
*G07B 17/04* (2006.01)

(52) U.S. Cl. ..... 705/401; 705/403; 705/404

(58) Field of Classification Search ..... 705/401, 705/403, 404
See application file for complete search history.

(56) References Cited

U.S. PATENT DOCUMENTS 5,444,631 A * 8/1995 Vermesse ..... 705/404
6,058,384 A * 5/2000 Pierce et al. ..... 705/50
7,120,610 B1 * 10/2006 Brookner et al. ..... 705/401
2002/0077990 A1 * 6/2002 Ryan, Jr. ..... 705/60
2002/0087493 A1 * 7/2002 Herbert ..... 705/406
2002/0164184 A1 * 11/2002 Evans et al. ..... 400/74
2003/0210789 A1 11/2003 Farnham et al.

FOREIGN PATENT DOCUMENTS

| | | |
|---|---|---|
| CA | 2 428 298 | 5/2002 |
| DE | 100 55 145 | 5/2002 |
| EP | 0 881 600 | 12/1998 |
| EP | 0 927 956 | 7/1999 |
| EP | 1 113 401 | 7/2001 |
| EP | 1113401 A1 * | 7/2001 |
| EP | 0 814 434 | 8/2003 |
| GB | 2 194 852 | 3/1988 |

OTHER PUBLICATIONS

Weaver, Peter, "Apply postage with a keystroke", Nation's Business, v85n12, pp. 56, Dec. 1997.*

* cited by examiner

*Primary Examiner*—John W Hayes
*Assistant Examiner*—Kevin Flynn
(74) *Attorney, Agent, or Firm*—Schiff Hardin LLP

(57) ABSTRACT

In a method for compensation of the first postage value of an unusable printed franking imprint billed in a billing module of a franking arrangement, the occurrence of the unusable franking imprint is detected as a first error event, error information associated with the error event is stored, and information derived from the error information is transmitted to a reimbursement entity for initiation of the reimbursement of the postage value. The error amount information associated with the error event is increased by the postage value and the error amount information is transmitted to the reimbursement entity for initiation of the reimbursement of the postage value.

29 Claims, 4 Drawing Sheets

METHOD AND ARRANGEMENT FOR COMPENSATING A POSTAGE MACHINE USER FOR PRINTED AND BILLED, BUT UNUSABLE FRANKING IMPRINTS

BACKGROUND OF THE INVENTION

1. Field of the Invention

The present invention concerns a method for refunding the first postage value of an unusable printed franking imprint that has been deducted in a billing module of a franking arrangement of the type wherein the franking imprint is detected in a detection step and error information associated with the error event is stored and information derived from the error information is transmitted to a reimbursement entity for authorization of the reimbursement of the postage value. The present invention furthermore concerns a franking arrangement suitable for implementation of such a method.

2. Description of the Prior Art

Franking arrangements such as, for example, franking machines, PC frankers or the like typically are used to generate a franking imprint on a mail piece or a label that is attached to a mail piece. This franking imprint serves as verification of payment of the required postage for the carrier of the mail piece. Such franking arrangements normally have a tamper-proof billing module in which a billing (charge) ensues for each franking imprint.

In the billing module, for each franking imprint one or more registers normally are changed by a value corresponding to the postage value to be printed in order to document the consumption (use) of postage by the franking arrangement. In order to prevent fraudulent manipulations, the billing in the billing module normally ensues at or immediately after the point in time at which the print data necessary for the franking imprint were generated. This billing point in time normally occurs a certain time span before the actual printing, i.e. the actual application of the print image on the appertaining medium.

If there is an interference in this time span after the billing and before the printing or during the printing, for example a paper jam or the like, despite the fact that billing has occurred, no franking imprint or no adequately legible (and thus usable) franking imprint is generated. In order to save the user of the franking arrangement the financial loss associated with such a situation, conventionally a series of measures have been proposed.

For example, in European Application 0 814 434 a method is disclosed wherein in such an error situation, data for franking imprints that have already been billed but are currently unusable are stored. For subsequent mail pieces to be franked, it is then checked whether the stored data can be used for the current mail piece. If this is the case, the franking imprint is generated with the stored data for which a billing has already occurred.

An immediate loss is thereby generally prevented for the user. It may be the case, however, that no comparable mail piece is to be franked for a long time, in particular given mail pieces with uncommon dimensions and weights that are seldom franked. Such mail pieces that occur seldomly have the additional disadvantage that they often require relatively high postage values, so a comparably large amount of credit is withheld by the stored data in the case of error. Additionally, such mail pieces are particularly prone to cause errors (such as a letter jam, etc.) due to their unconventional dimensions and weights.

In contrast to this European Application 1 113 401 A1 discloses a method of the general type initially described wherein a compensation request is made in a franking machine for each franking imprint that is detected as billed but is printed such that it is unusable, the compensation request being transmitted to a compensation entity. The compensation entity then checks the compensation request and, if applicable, authorizes (initiates) the compensation. Each compensation request thus includes a series of items of information such as the serial number of the franking machine, the current register state of the franking machine, the account number of the user of the franking machine and the compensation amount.

In a variant of this known method, the registration of the error events ensues offline, i.e. the compensation requests are collected in the franking machine and are transferred to a remote data center upon the next communication of the franking machine with the remote data center. The data center then processes the compensation requests and initiates the appropriate reimbursement.

With this known method it can be prevented that unusable credit is restricted in the franking machine over a longer time span. This known method, however, exhibits the disadvantage that the compensation request represents a relative large amount of data, such that on the one hand a comparably large amount of storage space is required for the individual compensation requirements (depending on the frequency of the errors). A relatively high storage capacity thus must be kept available for the compensation requirements, thereby increasing the production expenditure for the franking machine. Furthermore, a relatively large amount of data may possibly have to be transferred to the data center, such that the franking machine has to be operated for a relatively long period of time for this procedure or with an increased demand on the communication device. Lastly, a relatively long time span is necessary for sequentially processing the compensation requirements, whereby the otherwise-available processing capacities of the data center are limited.

SUMMARY OF THE INVENTION

An object of the present invention is to provide a method and a franking arrangement of the type initially described that do not exhibit the aforementioned disadvantages or at least alleviate those disadvantages and that ensure reliable compensation for unusable, printed franking imprints with the use of more economical components.

This object is achieved in accordance with the invention by a method for reliable compensation for not usably printed franking imprints wherein, in a first registration step, error amount information associated with an error event is increased by the postage value and, in a reporting step, the error amount information is transmitted to the refunding entity for initiation of reimbursement for the first postage value.

It is been shown that, compared to the known methods, the data volume to be processed can be significantly reduced by the simple summation of the postage amounts to be refunded. Both the necessary storage space for the compensation function and the transfer times for the compensation data are consequently also reduced. A sufficient security against fraudulent manipulations also can be simply achieved by appropriate (for example cryptographic) protection of the error amount information.

A simple and reliable compensation for billed but not usably printed franking imprints thus can be achieved with the present invention. As used herein, the term "billed but not usably printed franking imprints" encompasses both misprinted and completely unprinted franking imprints for which a billing has ensued in the billing module.

By the summary recording of postage values to be compensated for, information is in fact lost as to which type of "billed but not usably printed franking imprints" occurred (in the sense of the usage profile). This is nevertheless appropriate and reasonable because usage profiles should only record the franking imprints that are actually generated and have been shipped.

The error amount information preferably is incorporated into a usage profile of the franking arrangement that is generated anyway since it can be simply included therein due to the similar contents and formattings of the data fields, and processed later. A usage protocol associated with the franking arrangement is therefore preferably generated that, at least for a first category of usably printed further franking imprints, includes first category amount information about the sum of the postage values of the usable franking imprints of the first category that have been created in a first time span. Furthermore, this usage protocol includes the error amount information for the error events that occurred in the first time span.

In the reporting step, this usage protocol is then transmitted to the reimbursement entity, whereby at least the first error amount information and the entire usage protocol are preferably transmitted in a manner secured by cryptographic means. Securing the entire usage protocol has the advantage that the data quantity to be processed and transferred is reduced with the same security.

Securing the data to be transferred can ensue cryptographically in an arbitrary manner. Depending on the desired degree of confidentiality, different approaches can be used. Usually the authenticity of the usage protocol, in particular the authenticity of the first error amount information, is paramount as to prevention undetected fraudulent manipulations. In order to ensure the authenticity of the data to be transferred, adequate known authentication information can be generated about the data and appended to the data. Such known techniques as digital signatures or message authentication codes (MAC) preferably are used for this purpose. These can be created according to known methods (RSA, DSA, ECDSA, EIGamal or HMAC-SHA-1, etc.).

In order to guard against misuse of the compensation function, the error amount information preferably is checked according to at least one test criterion in a testing step. This can be an arbitrary suitable criterion with which misuse can be prevented or limited. The testing criterion preferably is the fact of exceeding a predetermined limit value for the reimbursement of postage. For example, an upper limit can be defined up to which an automatic reimbursement is permitted. If this value is exceeded, automatic reimbursement is no longer available to the user of the franking arrangement and, for example, the user must provide to the carrier with mail pieces with illegible (unusable) printed franking imprints in order to receive reimbursement. The user of the franking arrangement can then be informed about this requirement in an appropriate manner.

Alternatively, the testing criterion can be the fact of exceeding a predetermined limit value for the ratio between the error amount information and first consumption amount information, whereby the consumption amount information represents information about the postage values consumed in a time span for usably printed franking imprints. In other words, if the franking arrangement produces a certain fraction of rejections that exceeds this limit value, an appropriate response can be made. Specific maintenance routines can be initiated at the franking arrangement, for example.

The reimbursement entity can be an arbitrary service provider. Depending on the billing model for the frankings, the reimbursement entity can be the mail carrier or the manufacturer of the franking arrangement or a third party that only is responsible for billing the frankings, or the reimbursements for one of the two aforementioned entities.

In variants of the inventive method, testing and consolidation of the error amount information initially ensues via an intermediate entity before it is transmitted to the actual reimbursement entity. A further increase of the security thus can be achieved. In the reporting step, the first error amount information preferably is transmitted to a data center remote from the franking arrangement, in which the authenticity of the information preferably is checked in an authenticity testing step.

The error amount information can then be transmitted from such an intermediate entity—if applicable via one or more intermediate stations—to the reimbursement entity. The same security mechanisms, in particular the same authentication mechanisms, can be used that have already been described in connection with the transfer from the franking arrangement.

The present invention furthermore concerns a franking arrangement for generation of franking imprints, in particular a franking machine, with a processing unit; a billing module connected to the processing unit for billing (invoicing) postage values for franking imprints; a detection device connected to the first processing unit for detection of the occurrence of an error event in the form of a printed franking imprint billed by the billing module but which is unusable; and a memory in communication with the processing unit. The processing unit generates error information associated with the error event detected by the detection device and stores information derived from the error information. The information derived from the error information represents error amount information associated with the error event, and the processing unit is fashioned to increase the error amount information by a postage value associated with the error event upon detection of the error event by the detection device.

This franking arrangement is suited for implementation of the inventive method. The variants and advantages described above can be achieved to the same degree by this franking arrangement.

The present invention further concerns a system for compensation of the postage value of not usably printed franking imprint that has been billed in a billing module of a franking arrangement, including a franking arrangement as described above and a remote data center with a further processing unit that can be connected with the aforementioned processing unit of the franking arrangement via a communication network. This system is suited for implementation of the inventive method. The variants and advantages described above can be achieved by this system to the same degree as described above.

The present invention also concerns a data center for an inventive system for compensation of postage for any of the embodiments described above.

DESCRIPTION OF THE PREFERRED EMBODIMENTS

Figure 1:
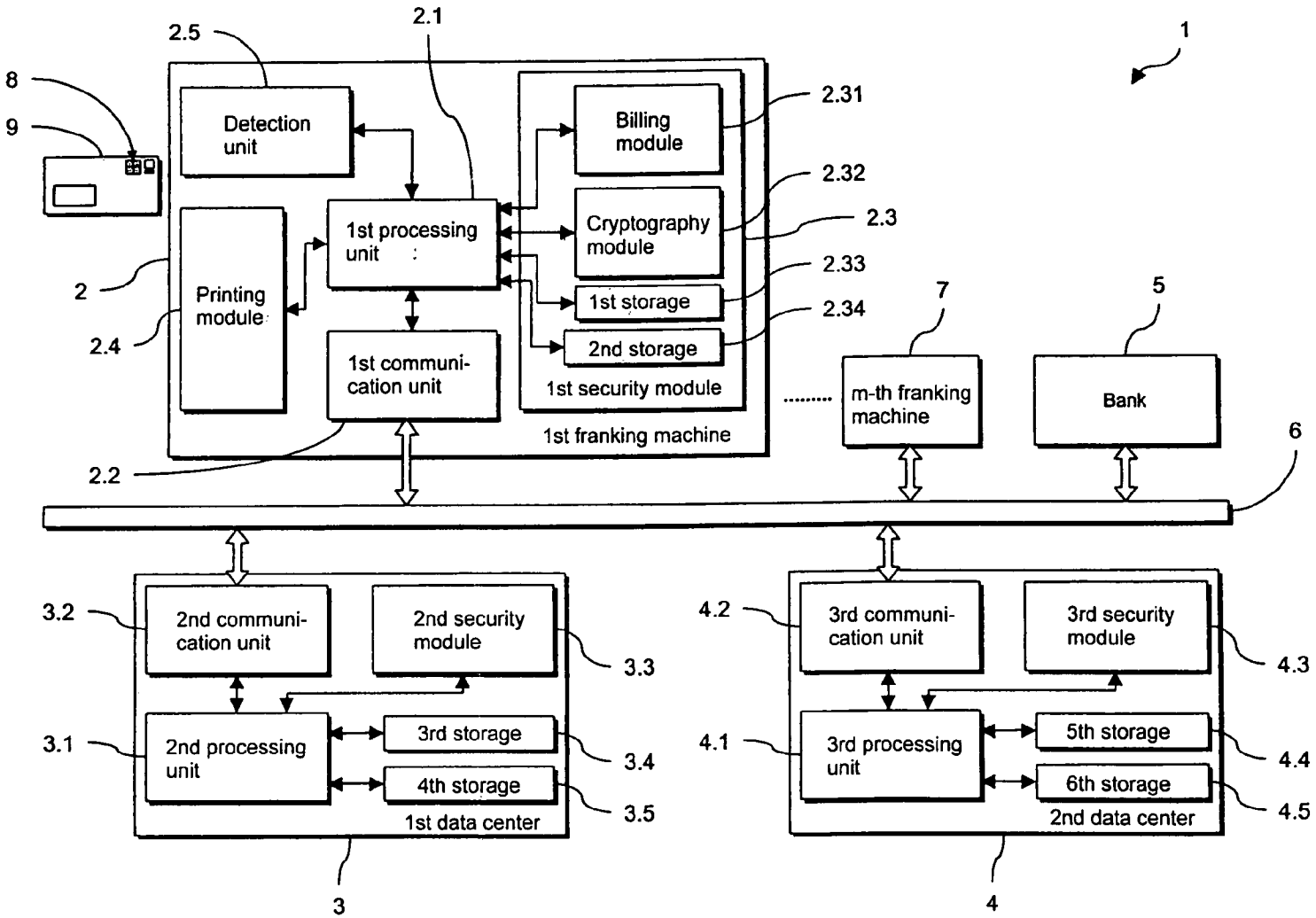
FIG. 1 is a schematic block diagram of a preferred embodiment of the inventive arrangement for implementation of a preferred embodiment of the inventive method for compensation of postage.

FIG. 1 shows a block diagram of a preferred embodiment of the inventive arrangement 1 for implementation of a preferred embodiment of the inventive method for compensation of postage values of billed but not usably printed franking imprints of a franking arrangement 2.

The arrangement 1 includes a franking arrangement in the form of a franking machine 2, a first data center 3 of the manufacturer of the franking machine 2, a second data center 4 of a mail carrier and a bank 5 of the user of the franking machine 2, which are each connected to a communication network 6. Further franking machines 7 that are identical in design and function with the franking machine 2 likewise can be connected to the communication network 6.

The franking machine 2 has a first processing unit 2.1 and a first communication unit in the form of a modem 2.2 connected therewith. Furthermore, the franking machine 2 has a first security module 2.3 connected with the first processing unit 2.1. The franking machine 2 also has a printing device in the form of a first printing module 2.4 that is connected by the first processing unit 2.1 and activated as well as a detection device 2.5 associated with the first printing module 2.4. The function of the detection device 2.5 is explained in detail further below.

The first security module 2.3 has a billing module 2.31, a cryptography module 2.32, a first memory 2.33 and a second memory 2.34. The billing module 2.31 serves for billing franking imprints 8 that are printed by the printing module 2.4 on mail pieces 9. As soon as the data necessary for the respective franking imprint 8 have been generated, the billing therefor ensues in the billing module 2.31. To this end, the register contained in the billing module 2.31 is increased (known as the ascending register) or decreased (known as the descending register) in a known manner by values that correspond to the printed postage value of the franking imprint 8.

If an interference occurs between the point in time of the billing and the completion of the printing event, for example a letter jam or the like, eventually no franking imprint 8 or no sufficiently legible (and thus no usable) franking imprint 8 is printed. In the sense of the present specification this represents a first error event.

The detection device 2.5 serves to detect such a first error event. It can be, for example, a simple camera, for example a CCD camera that detects whether a sufficiently legible (i.e. usable) franking imprint 8 follows the billing. If no such usable franking imprint 8 is detected, the detection device 2.5 sends a corresponding first error signal to the first processing unit 2.1.

The detection device can be fashioned differently in other variants of the invention in order to indicate the presence of a first error event to the first processing unit. In the simplest case, a switch operated by the user of the franking machine or the like can be provided as a detection device. It is also possible for the detection device to conclude the presence of a first error event from a number of other detected events—for example missing or wrong printing signals at the print head, interferences in the letter transport, etc.

The first data center 3 that, in the present example, is operated by the manufacturer of the franking machine 2, has a second processing unit 3.1 and a second communication unit in the form of a modem 3.2 connected therewith. Furthermore, the first data center has a second security module connected with the second processing unit 3.1 and a third memory 3.4 connected with the second processing unit 3.1.

The franking machine 2 can request or invoke specific services (such as, for example, the downloading of postage, etc.) from the first data center 3 via the communication network 6. For this purpose, it establishes a communication channel with the first data center 3 via its first communication unit 2.2, the communication network 6 and the second communication unit 3.2 of the first data center 3. As is explained in detail in the following, in the framework of such a communication the first error events that have occurred in the meantime are communicated from the franking machine 2 to the first data center 3, as a reimbursement entity, in order to initiate reimbursement for the billed but not usably printed postage.

The second data center 4 that, in the present example, is operated by the carrier of the franked mail pieces 9, has a third processing unit 4.1 and a third communication unit in the form of a modem 4.2 therewith. Furthermore, the second data center 4 has a third security module 4.3 connected with the third processing unit 4.1. The first data center 3 establishes a communication channel with the second data center 4 via the second communication unit 3.2, the communication network 6 and the third communication unit 4.2. As is explained in detail in the following, in the framework of such a communication the first error events communicated in the meantime from the franking machines 2, 7 are forwarded to the second data center 4 as a further reimbursement entity.

The second data center 4 thereupon transmits a corresponding reimbursement notification to the bank 5 via the communication network 6 in order to effect the actual reimbursement of the billed but not usably printed postage.

In the following, the steps of a preferred embodiment of the inventive method for compensation of the first postage value of not usably printed first franking imprint billed in a billing module of an inventive franking arrangement 2 are described with reference to FIGS. 1 through 4.

The method is started in a step 10.1. In a step 10.2, the first processing unit 2.1 checks whether a current franking process exists. If this is the case, in a detection step 10.3 the first processing unit 2.1 checks whether a first error event has been detected by the detection device 2.5. In other words, it is thus checked whether the current franking imprint is not usably printed first franking imprint.

If this is also the case, in a first registration step 10.4 a new first error amount value $FS_{new}$ is calculated, by an old first error amount value $FS_{old}$ stored in the first storage 2.33 of the first security module 2.3 being increased by a value P. The following thus applies:

$$FS_{new}=FS_{old}+P \tag{G1}$$

The value P is representative of the postage value of the current franking. The new first error amount value $FS_{new}$ is stored in the first memory 2.33 and represents first error amount information.

If in step 10.3 it is established that no first error event has been detected by the detection device 2.5, thus a usably printed second franking imprint exists, a new first category amount value $Ks_{i,new}$ is calculated in a second registration step 10.5, by an old first category amount value $KS_{i,old}$ (likewise stored in the first storage 2.33 of the first security module 2.3) being increased by the value P. The following thus applies:

$$KS_{i,new}=KS_{i,old}+P \tag{G2}$$

The new first category amount value $KS_{i,new}$ is stored in the first memory 2.33 and represents first category amount information. All generable franking imprints are divided into n different categories $K_i$ (with i=1 . . . n). Each category $K_i$ is associated with its own category amount value $KS_i$ in the first storage 2.33. That category amount value $KS_{i,new}$ to whose category the current second franking imprint belongs is therefore calculated and stored in the second registration step 10.5.

In the present example, the categories correspond to the individual products that are offered by the carrier of the mail pieces 9. This is, for example, a division into category 1: standard letter, domestic; category 2: compact letter, domestic; maxibrief, domestic; category 4: large letter, domestic; etc. as determined by the Deutsche Post AG (or by whatever postal authority is appropriate). It is understood that in other variants of the invention any other categorizations can be effected that possibly deviate from the categorization of the carrier.

In a step 10.6, the first processing unit 2.1 then checks whether a report about the first error events is to be transmitted to the first data center 3. Such a report is always transmitted, for example, when the franking machine 2 contacts the first data center 3 in order to request one or more services from the first data center 3. It is understood that, additionally or alternatively, such a report can be transmitted to the first data center 3 at regular intervals.

If this is the case, in a first report step 10.7 the first processing unit 2.1 initially checks the first error amount information for a first testing criterion in a first testing step 10.8.

This first testing criterion is stored in the second memory 2.34. This criterion can be the fact of exceeding a predeterminable numerical proportion limit value for the ratio between the number FA of the first error events (likewise stored in the first memory 2.33) and the number of the generated franking imprints in a first time span since the last report to the first data center 3. Depending on whether the numerical proportion limit value has been exceeded, error indicator information (FI) is generated that is likewise stored in the first memory 2.33.

Figure 3:
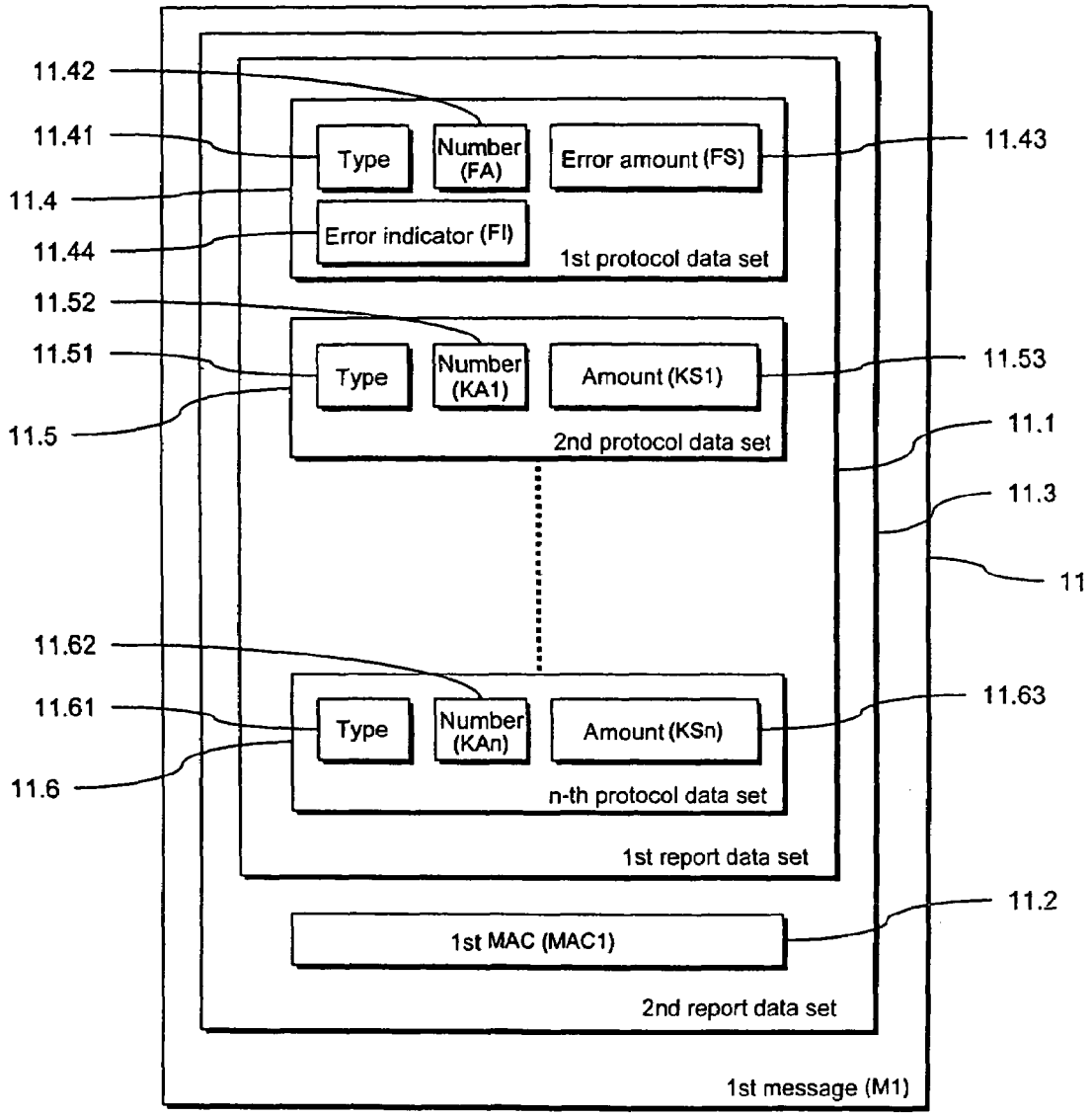
FIG. 3 schematically illustrates a first message that is generated in the method workflow according to FIG. 2.

In a step 10.9 a first message 11 (M11) is then generated, as schematically shown in FIG. 3. In a step 10.10 The first message 11 is then transmitted to the first data center as a reimbursement entity.

The first message 11 includes a first report data set 11.1 generated by the first processing unit 2.1 and first authentication information in the form of a first message authentication code (MAC1) that are combined into a second report data set 11.3 by the first processing unit 2.1.

The first report data set 11.1 includes a usage protocol of the franking machine 2 in the form of n protocol data sets 11.4, 11.5, 11.6. This usage protocol provides information (itemized according to the categories cited above) about the use of the franking machine 2 in the first time span since the last report to the first data center 3. Additionally, the usage protocol also contains the first error amount information FS that was generated in this time span since the last report.

Each protocol data set 11.4, 11.5, 11.6 includes a type indicator 11.41, 11.51, 11.61 that refers to the content of the respective protocol data set 11.4, 11.5, 11.6. The first protocol data set 11.4 thus contains a type indicator 11.41 that indicates that it is the protocol data set that contains the first error amount information FS. The remaining protocol data sets 11.5, 11.6 respectively contain a type indicator 11.51, 11.61 that indicates that it is the protocol data set that contains the category amount information $KS_i$ for the respective category $K_i$.

Furthermore, each protocol data set 11.4, 11.5, 11.6 contains a number indicator 11.42, 11.52, 11.62 that refers to the number of the franking imprints belonging to the respective protocol data set 11.4, 11.5, 11.6 in the first time span. The first protocol data set 11.4 thus contains a number indicator 11.42 (FA) that indicates that a number FA of first error events have occurred in the first time span. The remaining protocol data sets 11.5, 11.6 respectively contain a number indicator 11.52, 11.62 (KAi) that indicates that a number KAi of franking imprints 8 have been associated with the category $K_i$ in the first time span.

Finally each protocol data set 11.4, 11.5, 11.6 contains an amount indicator 11.43, 11.53, 11.63 that refers to the amount of the postage values of the franking imprints belonging to the respective protocol data set 11.4, 11.5, 11.6 in the first time span. The first protocol data set 11.4 thus contains the first error amount information FS as an amount indicator 11.42. The remaining protocol data sets 11.5, 11.6 contain the respective category amount information ($KS_i$) of the franking imprints 8 that have been associated with the category $K_i$ as amount indicator 11.53, 11.63.

As a further data field, the first protocol data set 11.4 additionally contains the error indicator information (FI). This error indicator information (FI) enables the operator of the first data center 3 to draw conclusions about error functions of the franking machine 2 and, if applicable, to initiate corresponding countermeasures. It is understood that in other variants of the invention this error indicator information (FI) can be transmitted separately or generated at another location, for example in the first data center.

In the step 10.9, with access to the cryptography module 2.32 the first processing unit 2.1 generates the first MAC 11.2 (MAC1), over the first report data set 11.1 according to a known algorithm stored in the cryptography module 2.32 for generation of such a MAC (for example an HMAC algorithm). For this purpose, it uses (in a known manner) a secret first key that is stored in the cryptography module 2.32. The first MAC 11.2 (MAC1) serves for cryptographic securing of the information over which it was generated.

In other variants of the invention method, the first MAC 11.2 (MAC1) can be generated only over a part of the first report data set. This part preferably contains the first error amount information (FS) in order to preclude undetected manipulations in this area. Furthermore, in other variants of the inventive method, a first digital signature can also be generated instead according to a known signature algorithm, for example RSA, DSA, ElGamal, ECDSA, etc.

In step 10.9, the first processing unit 2.1 generates the second report data set 11.3 from the first report data set 11.1 and the first MAC 11.2 (MAC1). The second report data set 11.3 is incorporated into the first message 11 (M1) that is transmitted to the first data center 3 via the communication network 6 in a step 10.10.

In a second testing step 10.11, the first data center 3 tests the first message 11 (M1). For this purpose, in an authentication testing step the second processing unit 3.1 verifies the first MAC 11.2 (MAC1), initially with access to the second security module 3.3. For this purpose, it uses the algorithm stored in the second security module 3.3 for generation of such a MAC (for example an HMAC algorithm, etc.) as well as the secret first key, that is likewise stored in the second security module 3.3. If the verification is successful, it is established that no manipulations have occurred since the generation of the first report data set 11.1 with the usage protocol.

Furthermore, in the second testing step 10.11 the first data center 3 checks the content of the first message 11 (M1), in particular the content of the second data set 11.3, according to at least one predetermined second testing criterion that, in the present example, is stored in the third memory 3.4 of the first data center 3.

This second testing criterion can be the fact of exceeding a predeterminable first error amount limit value ($FS_{max}$) for the first error amount information 11.43 (FS) contained in the first protocol data set 11.4. If this first error amount limit value has not been exceeded, the first error amount information (FS) is stored as a first compensation information (EI1) in a first storage region (associated with the franking machine 2) of a fourth memory 3.5 of the first data center 3. Otherwise, the error amount limit value ($FS_{max}$) is stored in the first storage region of the fourth memory 3.5 as first compensation information (EI1). The content of the first storage region of the fourth memory 3.5, thus the first compensation information (EI1) associated with the franking machine 2, is used in the following as a basis for the reimbursement.

This checking of the second testing criterion, in a simple manner, enables limiting of the automatic reimbursement of postage for billed but not usably printed franking imprints. Large scale attempts to defraud can be effectively counteracted. If a limitation of the automatic reimbursement occurs, a message can be transmitted to the user of the franking machine in a suitable manner, for example via the franking machine, in which he is notified of the limitation as well as that a compensation in excess of this is only possible by presenting the not usably printed franking imprints.

The fourth memory 3.5 has such a storage region for each of the m franking machines 2, 7 in which the compensation information (EIj with j=1 . . . m) associated with the respective franking machine 2, 7 is stored in the specified manner. Different error amount limit values, moreover, can be predetermined for different franking machines.

In a step 10.12, the second processing unit 3.1 checks whether a report with the compensation information is to be transmitted to the second data center 4. Such a report is, for example, transmitted at regular intervals. Additionally or alternatively, such a report can be transmitted to the second data center 4 upon initiation by specific events, for example a corresponding request by the second data center.

Figure 4:
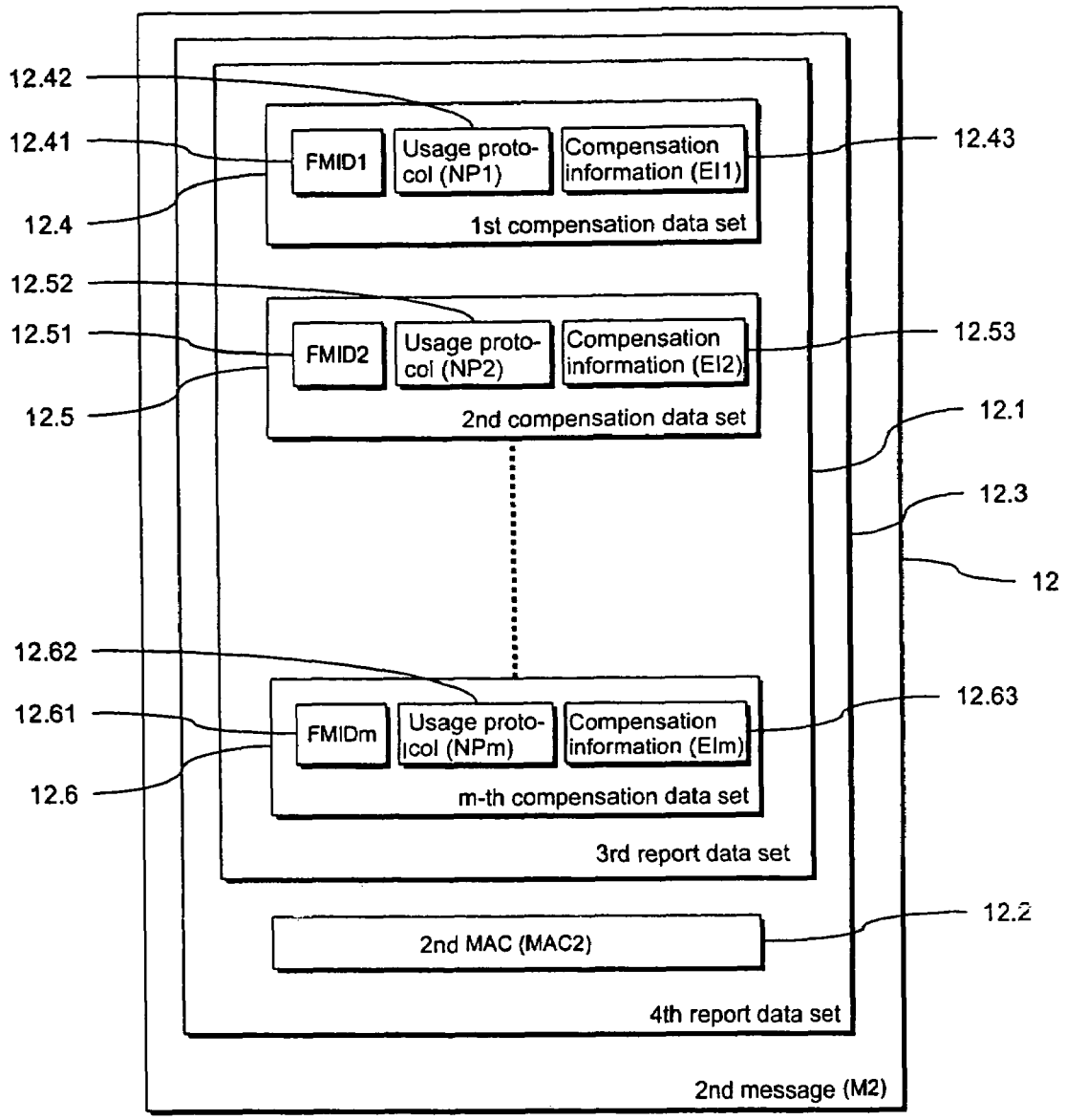
FIG. 4 schematically illustrates a second message that is generated in the method workflow according to FIG. 2.

If this is not the case, the method jumps back to step 10.2. Otherwise, in a second report step 10.13 the second processing unit 3.1 initially generates a second message (M2) in a step 10.14, as is schematically shown in FIG. 4. The second message 12 is then transmitted to the second data center 3 of the carrier of the franked mail pieces 9 in a step 10.15.

The second message includes a third report data set 12.1 generated by the second processing unit 3.1 and second authentication information in the form of a second message authentication code 12.2 (MAC2) that are combined by the second processing unit 2.1 into a fourth report data set 12.3.

The third report data set 12.1 thus contains a compensation protocol of the m franking machines 2, 7 in the form of m compensation data sets 12.4, 12.5, 12.6. For the respective franking machine 2, 7, this compensation protocol gives information about the compensation to be effected for billed but not usably printed franking imprints in the first time span cited above. The compensation protocol also additionally contains the respective usage protocol (NPk) for the first time span for the k-th franking machine (with k=1 . . . m).

Each compensation data set 12.4, 12.5, 12.6. contains an identification (FMIDk with k=1 . . . m) of the franking machine 2, 7 with which it is associated. Furthermore, each compensation data set 12.4, 12.5, 12.6 contains the usage protocol (NPk) 12.42, 12.52, 12.62 of the franking machine 2, 7 with which it is associated. Finally, each compensation data set 12.4, 12.5, 12.6 contains the current compensation information (EIk with k=1 . . . m) 12.43, 12.53, 12.63, stored in the respective storage region of the fourth memory 3.5, that is associated with the appertaining franking machine 2, 7.

Alternatively, depending on the temporal overlap or difference between the first report step 10.7 and the second report step 10.13, it can also be provided that individual compensation data sets can remain empty when no new first report step 10.7 has ensued for the appertaining franking machine 2, 7, for example since the last second report step 10.13. As another alternative, the compensation data sets can contain consolidated (i.e. summed) compensation information (EIk) when multiple first report steps 10.7 have occurred for the appertaining franking machine 2, 7 since the last second report step 10.13.

In the step 10.14, with access to the second security module 3.3 the second processing unit 3.1 generates the second MAC 12.2 (MAC2) over the third report data set 12.1 according to a known algorithm (stored in the second security module 3.3) for generation of such a MAC (for example an HMAC algorithm, etc.) For this, it uses a secret second key that is stored in the second security module 3.3. The second MAC 12.2 (MAC2) likewise serves for cryptographically securing the information over which it was generated.

In other variants of the inventive method, the second MAC 12.2 (MAC2) can be generated only over a part of the third report data set. This part preferably contains the respective compensation information (EIk) in order to preclude undetected manipulations in this area. Furthermore, it is understood that, in other variants of the inventive method, instead of the MAC a second digital signature can also be created according to a known signature algorithm, for example RSA, DSA, EIGamal, ECDSA, etc.

In the step 10.14, the second processing unit 3.1 generates the fourth report data set 12.3 from the third report data set 12.1 and the second MAC 12.2 (MAC2). This fourth report data set 12.3 is incorporated into the second message 12 (M2) that is transmitted to the second data center 4 over the communication network 6 in a step 10.15.

In a step 10.16, the second data center 4 checks the second message 12 (M2). For this purpose, in a further authentication testing step the third processing unit 4.1 verifies the second MAC 12.2 (MAC2), initially with access to the third security module 4.3. For this purpose, it uses the corresponding algorithm stored in the third security module 4.3 for generation of such a MAC (for example an HMAC algorithm, etc.) as well as the secret second key that is likewise stored in the third security module 4.3. If the verification is successful, it is established that no manipulations have occurred since the generation of the third report data set 12.1 with the compensation protocol.

Furthermore, in the step 10.16 the second data center 4 checks the content of the second message 12 (M2), in particular the content of the fourth data set 12.3, according to at least one predetermined third testing criterion that, in the present example, is stored in the fifth memory 4.4 of the second data center 4.

This third testing criterion can be an arbitrary further testing criterion that the carrier of the franked mail pieces 9 establishes with regard to the generation. This, for example, can be the fact of exceeding a predeterminable further error amount limit value. If this further error amount limit value is not exceeded, the first compensation information (EIk) is stored as disbursement information in a second storage region (associated with the respective franking machine 2) of a sixth memory 4.5 of the second data center 4. Otherwise the further error amount limit value is stored as disbursement information in the second storage region of the sixth memory 4.5. The content of the second storage region of the sixth memory 4.5 is used in the following as a basis for the reimbursement.

In order to finally initiate reimbursement, in a step 10.17 the second data center 4 sends a compensation message (EM) with the disbursement information (stored in the second storage region of the sixth memory 4.5) to the bank 5 over the communication network 6. The bank 5 then initiates the actual reimbursement in the form of a remittance of the sum corresponding to the disbursement information to a registered account of the user of the respective franking machine 2, 7.

A different type of compensation alternatively can be provided in other variants of the inventive method. For example, a credit increased by the compensation amount can be loaded into the franking machine at the next download event. Another alternative is to change the account of the user of the franking machine with an amount reduced by the compensation amount in connection with the next download event into the franking machine.

In a step 10.18, it is finally checked whether the method should be ended. If this is the case, the method ends in a step 10.19. Otherwise the method jumps back to the step 10.2.

Figure 2:
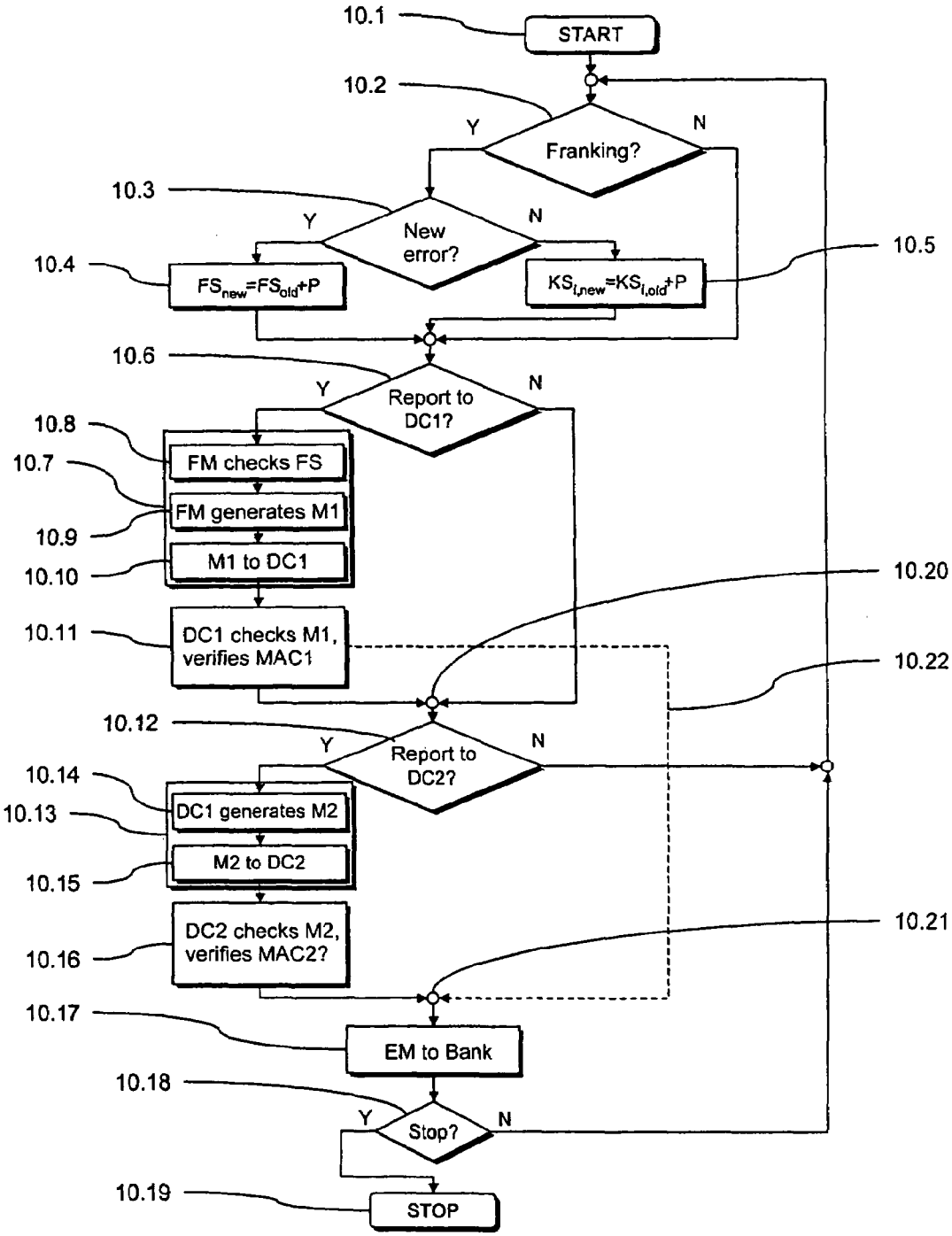
FIG. 2 is a flowchart of a preferred embodiment of the inventive method for compensation of postage that is implemented with the arrangement of FIG. 1.

The present invention was described in the preceding using an example in which the reimbursement was initiated via the first and second data centers. It is understood that, in other variants of the inventive method, the compensation can ensue only via one data center. The steps between the points 10.20 and 10.21 in FIG. 2 that concern the steps with regard to the second data center can, if applicable, also be omitted, as this is indicated in FIG. 2 by the dashed arrow 10.22. In other words, the disbursement information can be generated and transferred directly to the bank by the first data center 3.

Furthermore, it is understood that the testing of the testing criteria can be distributed between the individual components of the arrangement 1 in any suitable manner. The testing of all testing criteria can in particular ensue in a single component of the arrangement 1, for example the first data center 3.

The present invention was described in the preceding using an example with franking machines, but it is understood that other franking arrangements, for example those known as PC frankers or the like, can be used in other variants of the invention.

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for compensating a user of franking equipment arrangement for a postage value of a not usably printed franking imprint, that has been automatically billed to the user, comprising the steps of:

(a) through a computerized processor of said franking equipment detecting, as an error event, an occurrence of a billed but not usably printed franking imprint having a postage value;

(b) upon each occurrence of an error event, in said computerized processor, only electronically storing error amount information associated with detecting of each error event, said error amount information consisting of accumulated postage values for previously detected error events, and incrementing said error amount information solely by the postage value of each detected error event; and (c) transmitting said error amount information from said computerized processor to a computerized reimbursement entity, remote from said franking equipment arrangement and, at said computerized reimbursement entity, initiating reimbursement of said user for said postage value represented in said error amount information.

2. A method as claimed in claim 1 comprising generating a usage protocol associated with said franking arrangement and in said usage protocol including information designating a monetary value of postage values for usable franking imprints generated within a predetermined time span by said franking equipment, and including said error amount information for said time span.

3. A method as claimed in claim 2 comprising transmitting said usage protocol to said computerized reimbursement entity in step (c).

4. A method as claimed in claim 3 comprising transmitting at least said error amount information in said usage protocol in a cryptographically secured manner.

5. A method as claimed in claim 4 comprising, in step (c):

generating a first report data set comprising said error amount information;

generating authentication information for said first report data set;

generating a second report data set comprising said first report data set and said authentication information;

transmitting said second report data set to said reimbursement entity.

6. A method as claimed in claim 5 comprising generating said authentication information from the group consisting of a digital signature for said first report data set and a message authentication code over said first report data set.

7. A method as claimed in claim 1 comprising checking said error amount information with respect to at least one test criterion.

8. A method as claimed in claim 7 comprising selecting said testing criterion from the group consisting of exceeding a predetermined limit value for reimbursement of postage, exceeding a predetermined limit value for a ratio between said error amount information and consumption amount information representing postage values for usable franking imprints printed by said franking equipment in a time span equal to a time span encompassing said error amount information, and exceeding a predetermined limit value for a ratio between a number of said error events and a total number of franking imprints generated by said franking arrangement in a predetermined time span.

9. A method as claimed in claim 8 comprising transmitting said error amount information to a data center remote from said franking equipment arrangement in step (c), and conducting said testing of said error amount information with regard to said at least one testing criterion at said data center.

10. A method as claimed in claim 9 wherein said data center is a first data center, and that includes generating a report data set at said first data center comprising said error amount information and derived information generated by said first data center using said error amount information, and transmitting said report data set from said first data center to a second data center, remote from said first data center, serving as said computerized reimbursement entity.

11. A method as claimed in claim 10 comprising generating authentication information at said first data center for said report data set, generating a further report data set at said first data center comprising said report data set and said authentication information, and transmitting said further report data set from said first data center to said second data center.

12. A method as claimed in claim 11 comprising generating said authentication information from the group consisting of a digital signature for said report data set and a message authentication code over said report data set.

13. A franking machine comprising:

a processor;

a printer operated by the processor to print franking imprints;

a billing module connected to the processor configured to automatically generate an electronic monetary charge for a postage value associated with each franking imprint at a time that each franking imprint is printed by said printer unit;

a detector connected to said processor that detects an occurrence of a franking imprint not usably printed by said printing unit, and that indicates a first error event to said processor upon each detection of a not usably printed franking imprint;

a memory connected to said processor;

said processor being configured to generate error amount information upon an occurrence of each error event, said error amount information indicating only the monetary charge automatically generated by said billing module for said not usably printed franking imprint that caused such event, said processor being configured to only cause said error information to be stored in said memory and increment said error amount information in said memory, upon each occurrence of an error event, solely by said charge billed by said billing module for said respective not usably printed franking imprints causing said respective error events; and an output unit operated by said processor and configured to communicate with a computerized reimbursement entity located remote from said franking machine, said processor operating said output unit to transmit at least said error amount information to said reimbursement entity.

14. A franking machine as claimed in claim 13 wherein said processor is configured to generate a usage protocol including information designating monetary charges automatically generated by said billing module respectively for postage values for usable franking imprints generated within a predetermined time span by said printer, and including said error amount information for said time span.

15. A franking machine as claimed in claim 13 wherein said processor is configured to provide at least said error amount information in a cryptographically secured manner for transmission to said computerized reimbursement entity.

16. A franking machine as claimed in claim 15 wherein said processor is configured to generate a first report data set comprising said error amount information, to generate authentication information for said first report data set, generates a second report data set comprising said first report data set and said authentication information, and to cause said output unit to transmit said second report data set to said computerized reimbursement entity.

17. A franking machine as claimed in claim 16 wherein said processor is configured to generate said authentication information from the group consisting of a digital signature for said first report data set and a message authentication code over said first report data set.

18. A franking machine as claimed in claim 13 wherein said memory is a first memory and wherein said franking machine comprises a second memory and wherein said processor is configured to check said error amount information with respect to at least one test criterion stored in said second memory.

19. A franking machine as claimed in claim 16 wherein said second memory contains said testing criterion selected from the group consisting of exceeding a predetermined limit value for reimbursement of postage, exceeding a predetermined limit value for a ratio between said error amount information and consumption amount information representing postage values for usable franking imprints printed by said printer in a time span equal to a time span encompassing said error amount information, and exceeding a predetermined limit value for a ratio between a number of said error events and a total number of franking imprints printed by said printer in a predetermined time span.

20. A mail processing arrangement comprising:

a franking machine comprising a processor, a printer operated by the processor to print franking imprints, a billing module connected to the processor configured to automatically generate an electronic monetary charge for a postage value associated with each franking imprint to be printed by said printer unit, a detector connected to said processor that detects an occurrence of a franking imprint not usably printed by said printing unit, and that indicates a first error event to said processor upon each detection of a not usably printed franking imprint, a memory connected to said processor, said processor being configured to generate error amount information upon an occurrence of each error event, said error amount information indicating only the monetary charge automatically generated by said billing module for said not usably printed franking imprint that caused said error event, said processor being configured to only cause said error amount information to be stored in said memory and increment said error amount information in said memory, upon each occurrence of an error event, solely by the monetary charge billed by said billing module for said respective not usably printed franking imprints causing said respective error events, and an output unit operated by said processor; and a computerized reimbursement entity located remote from said franking machine, said processor operating said output unit to transmit at least said error amount information to said computerized reimbursement entity.

21. An arrangement as claimed in claim 20 wherein said processor is configured to generate a usage protocol associated with said franking machine including information designating a monetary value of postage values for usable franking imprints generated with a predetermined time span by said printer, and including said error amount information for said time span.

22. An arrangement as claimed in claim 20 wherein said processor is configured to provide at least said error amount information in said usage protocol in a cryptographically secured manner for transmission to said computerized reimbursement entity.

23. An arrangement as claimed in claim 22 wherein said processor is configured to generate a first report data set comprising said error amount information, to generate authentication information for said first report data set, to generate a second report data set comprising said first report data set and said authentication information, and to cause said output unit to transmit said second report data set to said computerized reimbursement entity.

24. An arrangement as claimed in claim 23 wherein said processor is configured to generate said authentication information from the group consisting of a digital signature for said first report data set and a message authentication code over said first report data set.

25. An arrangement as claimed in claim 20 wherein said reimbursement entity comprises a checking unit configured to check said error amount information with respect to at least one test criterion.

26. An arrangement as claimed in claim 25 wherein said checking unit employs a test criterion selected from the group consisting of exceeding a predetermined limit value for reimbursement of postage, exceeding a predetermined limit value for a ratio between said error amount information and consumption amount information representing postage values for usable franking imprints printed by said printer in a time span equal to a time span encompassing said error amount information, and exceeding a predetermined limit value for a ratio between a number of said error events and a total number of franking imprints generated by said printer in a predetermined time span.

27. An arrangement as claimed in claim 26 comprising a data center in communication with said output unit, configured to generate a report data set comprising said error amount information received from said output unit and derived information generated by said data center using said error amount information, and that to transmit said report data set from said data center to said computerized reimbursement entity, remote from said data center.

28. An arrangement as claimed in claim 27 wherein said data center is configured to generate authentication information for said report data set, to generate a further report data set comprising said report data set and said authentication information, and to transmit said further report data set from said data center to said computerized reimbursement entity.

29. An arrangement as claimed in claim 28 comprising wherein said data center is configured to generate said authentication information from the group consisting of a digital signature for said report data set and a message authentication code over said report data set.

* * * * *